United States Patent [19]

Mayer et al.

[11] 3,982,053

[45] Sept. 21, 1976

[54] PROCESS FOR FLAMEPROOFING ORGANIC FIBER MATERIAL BY THE TRANSFER PROCESS

[75] Inventors: Fritz Mayer, Haltingen, Germany; Jőrg Kern, Oberwil; Hermann Nachbur, Dornach, both of Switzerland

[73] Assignee: Ciba-Geigy AG, Basel, Switzerland

[22] Filed: June 18, 1974

[21] Appl. No.: 480,336

[30] Foreign Application Priority Data

June 22, 1973 Switzerland ..... 9187/73
July 26, 1973 Switzerland ..... 10929/73

[52] U.S. Cl. ..... 427/248; 8/2.5 A; 101/470

[51] Int. Cl.[2] ..... C23C 11/00; C09K 3/28

[58] Field of Search ..... 117/136; 427/248; 8/2.5; 156/230; 101/470

[56] References Cited

UNITED STATES PATENTS

| | | | |
|---|---|---|---|
| 3,549,307 | 12/1970 | Hirsch | 427/248 X |
| 3,645,936 | 2/1972 | Gardner | 117/136 |
| 3,650,820 | 3/1972 | DiPietro et al. | 117/136 |
| 3,660,582 | 5/1972 | DiPietro et al. | 117/136 |
| 3,666,402 | 5/1972 | Meyers et al. | 117/136 |
| 3,715,310 | 2/1973 | Butcher | 117/136 |

FOREIGN PATENTS OR APPLICATIONS

| | | | |
|---|---|---|---|
| 2,263,140 | 7/1973 | Germany | 427/248 |
| 1,191,569 | 3/1968 | Germany | 428/921 |
| 1,100,605 | 1/1968 | United Kingdom | 428/921 |

*Primary Examiner*—Harry J. Gwinnell
*Attorney, Agent, or Firm*—Joseph G. Kolodny; Edward McC. Roberts; Prabodh I. Almaula

[57] ABSTRACT

A process for flameproofing organic fiber material by the dry thermal transfer process is provided. In this process, a preparation is applied to an inert carrier which is then brought into contact with fiber materials, such as polyamide, polyacrylonitrile or linear polyester fibers; thereafter the carrier and the material are subjected to a heat treatment at not less than 80°C and the finished material is then separated from the carrier. The preparation used in this process contains a halogen compound of the formula

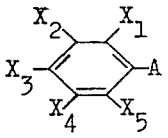

wherein A is halogen, hydroxyl, alkoxycarbonyl, halogenoalkoxy or halogenophenyl and $X_1$, $X_2$, $X_3$, $X_4$ and $X_5$ are each halogen, alkyl, hydroxl or hydrogen, but at most one of the radicals $X_1$, $X_2$, $X_3$, $X_4$ and $X_5$ is alkyl or hydroxyl and at least one of the radicals is halogen, and $X_1$ and A can together be a radical of the formula —CO—O—CO.

12 Claims, No Drawings

PROCESS FOR FLAMEPROOFING ORGANIC FIBER MATERIAL BY THE TRANSFER PROCESS

The subject of the invention is a process for the flameproofing of organic fibre material by the dry thermal transfer process, characterised in that a preparation which contains at least a. a halogen compound of the formula (1) 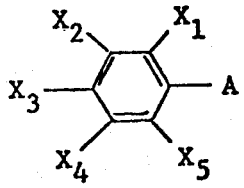

wherein A denotes halogen, hydroxyl, alkoxycarbonyl with 2 to 5 carbon atoms, halogenoalkoxy with 1 to 4 carbon atoms or halogenophenyl and $X_1$, $X_2$, $X_3$, $X_4$ and $X_5$ each denote halogen, alkyl with 1 to 4 carbon atoms, hydroxyl or hydrogen, but at most one of the radicals $X_1$, $X_2$, $X_3$, $X_4$ and $X_5$ represents alkyl or hydroxyl and at least one represents halogen, and $X_1$ and A can together represent a radical of the formula -CO—O—CO—, b. optionally a binder which is stable below 250°C and c. optionally a solvent is applied to an inert carrier and is optionally dried, the carrier is then brought into contact with the surface of the fibre material which is to be flameproofed, and thereafter the carrier and the material to be finished are subjected to a heat treatment at not less than 80°C, if appropriate with use of mechanical pressure, until the halogen compound has been transferred to the fibre material, and the finished material is then separated from the carrier.

In the process according to the invention, the components a) which are used are preferably compounds of the formula (2) 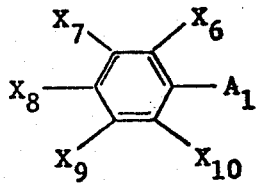

wherein $A_1$ denotes bromine, hydroxyl, alkoxycarbonyl with 2 or 3 carbon atoms, bromoalkoxy with 2 or 3 carbon atoms and 1 to 3 bromine or bromophenyl with 1 to 5 bromine and $X_6$, $X_7$, $X_8$, $X_9$ and $X_{10}$ each denote bromine, methyl, hydroxyl or hydrogen, but at most one of the radicals $X_6$, $X_7$, $X_8$, $X_9$ and $X_{10}$ represents hydroxyl and at leaset one of these radicals represents bromine, and $X_6$ and $A_1$ can together represent a radical of the formula —CO—O—CO—.

It is of particular interest to use compounds of the formula (3) 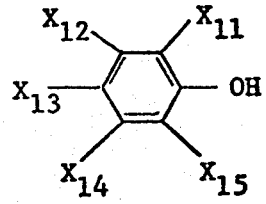

wherein $X_{11}$, $X_{12}$, $X_{13}$, $X_{14}$ and $X_{15}$ each denote hydrogen, methyl or bromine, with at least three of the radicals $X_{11}$, $X_{12}$, $X_{13}$, $X_{14}$ and $X_{15}$ representing bromine.

Examples of very suitable compounds are those of the formulae (4.1) 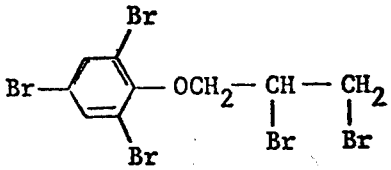

(4.2) 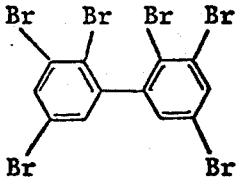

(4.3) 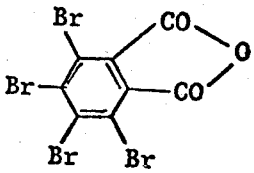

or above all (4.4)

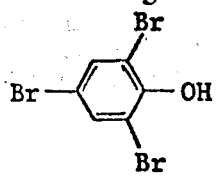

and especially (4.5)

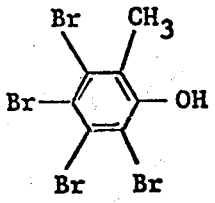

The radical A represents, for example, chlorine or especially bromine; examples of alkoxycarbonyl groups are carboxyl groups esterified with n-butanol, n-propanol, isopropanol, ethanol or above all methanol; halogenoalkoxy groups are as a rule monohalogenated to tetrahalogenated alkoxy radicals, wherein halogen is again primarily chlorine and above all bromine, examples of such radicals being chloromethyl, bromomethyl, 2-chloroethyl, 2,3-dibromo-n-propyl,2,2,3-tribromo-n-propyl, 2,2,3,3-tetrabromo-n-propyl and 2-chloro-2,3-dibromo-n-propyl; halogenophenyl as a rule represents monohalogenated to pentahalogenated, that is to say chlorinated or above all brominated, phenyl radicals such as p-bromophenyl, 2,3,5-tribromophenyl or pentabromophenyl.

As halogen, the X radicals as a rule represent chlorine or especially bromine, whilst alkyl can above all be such radicals as n-butyl, n-propyl, isopropyl, ethyl and especially methyl. Preferably, at least 3 X radicals represent halogen.

The compounds of the formula (1) are known and are manufactured according to known methods.

In addition to the flameproofing agent of the formula (1) which is transferred to the fibre material, the preparations which can be used in accordance with the process can also contain at least one binder which is stable below 250°C, water and/or an organic solvent.

Suitable binders are synthetic, semi-synthetic and natural resins, and in particular both polycondensation and polyaddition products. In principle, all binders customary in the lacquer and printing ink industry can be used. The binders serve to retain the compounds of the formula (1) on the treated position of the carrier. At the transfer temperature they should, however, not melt, not react with themselves, for example crosslink, and be capable of releasing the compound to be transferred. Preferred binders ae those which, for example, dry in a warm stream of air and form a fine, preferably non-tacky, film on the carrier. As examples of suitable water-soluble binders there may be mentioned: alginate, tragacanth, carubin (from carob bean flour), dextrin, etherified or esterified vegetable mucins, caboxymethylcellulose or polyacrylamide, whilst as binders soluble in organic solvents there may be mentioned cellulose esters, such as nitrocellulose or cellulose acetate and especially cellulose ethers, such as methylcellulose, ethylcellulose, propylcellulose, isopropylcellulose, benzylcellulose or hydroxyethylcellulose as well as their mixtures. Particularly good results are obtained with ethylcellulose.

As organic solvents it is possible to use water-miscible or water-immiscible organic solvents or solvent mixtures of boiling point below 150°C, preferably below 120°C, under normal pressure. Advantageously, aliphatic, cycloaliphatic or aromatic hydrocarbons, such as toluene, cyclohexane, or petroleum ether, lower alkanols, such as methanol, ethanol, propanol, isopropanol, esters of aliphatic monocarboxylic acids, such as ethyl acetate or propyl acetate, aliphatic ketones, such as methyl ethyl ketone and halogenated aliphatic hydrocarbons, such as perchloroethylene, trichloroethylene, 1,1,1-trichloroethane or 1,1,2-trichloro-2,2,1-trifluoroethylene are used. Particularly preferred solvents are lower aliphatic esters, ketones or alcohols, such as butyl acetate, acetone, methyl ethyl ketone, isopropanol or butanol, as well as their mixtures, for example a mixture of methyl ethyl ketone and ethanol in the ratio of 1:1. The desired viscosity of the printing pastes can then be obtained by adding the stated binders together with a suitable solvent.

The weight ratio of the individual components in the preparation can vary greatly and is, for example, from 20 to 100 per cent by weight in the case of the compounds of the formula (1), from 0 to 30 per cent by weight in the case of the binder, and from 0 to 70 per cent by weight in the case of water or the organic solvent or solvent mixture, relative to the total weight of the preparation. The amounts of compound, to be transferred to the fibre material, applied to the temporary carrier can be, for example, 10 to 100 g, preferably 20 to 50 g, per $m^2$ of carrier.

The preparations used according to the invention are prepared by dissolving of finely dispersing the compound of the formula (1) in water and/or organic solvent, advantageously in the presence of a binder which is stable below 250°C.

Further, it is also possible to apply compounds of the formula (1) directly as such onto the carrier, that is to say without solvents or binder, for example by sprinkling, doctoring, pouring, spraying or padding.

The process according to the invention is suitably carried out by applying the preparation to an inert temporary carrier, bringing the treated side of the carrier into contact with the fibre material which is to be treated, subjecting the carrier and the fibre material to the action of heat at not less than 80°C, preferably not less than 130°C, and separating the fibre material from the carrier.

The temporary carrier required in accordance with the process can be endless or be matched to the textile shapes which are to be treated, that is to say cut into shorter or longer pieces. As a rule it has no affinity for the preparation used. Suitably, the carrier is a flexible, preferably dimensionally stable, band, a strip or a film, preferably having a smooth surface, which is stable to heat and can consist of materials of the most diverse kind, for example metal, such as an aluminium foil or steel foil or a steel fibre fleece, plastic, paper or textile sheet-like structures, such as woven fabrics, knitted fabrics or fleeces which are optionally coated with a film of vinyl resin, ethylcellulose, polyurethane resin or polytetrafluoroethylene. A felt of polytetrafluoroethylene fibres is also appropriate. Suitably, flexible aluminium foils, sheets of glass fibre farics or above all sheets of paper are used.

After the preparations have been applied to the carrier, they are dried, for example by means of a warm stream of air or by infra-red irradiation, the solvent used optionally being recovered.

The treated side of the carrier is thereupon brought into close contact with the surface of the fibre material to be treated, and the combination is subjected to a heat treatment at not less than 80°C and preferably 150° to 220°C, particularly 150° to 200°C.

These temperatures are maintained for a sufficient period of time, preferably 5 to 120 seconds, until the compounds of the formula (1) have been transferred to the fibre material to be treated.

Changes in temperature and in time can result in corresponding changes in the amount of coating for the same chemicals presented. It is therefore possible to regulate the transfer of the chemicals to the fibre material, and hence the amount of coating, through regulating the temperature and the transfer time.

The exposure to heat can be effected in various known ways, for example by means of a heating plate or by passing through a tunnel-shaped heating zone or over a hot heating drum, advantageously in the presence of an unheated or heated counter-roller which exerts pressure, or through a hot calender, or by means of a heated plate (iron or warm press) optionally in vacuo, the heating devices being preheated to the requisite temperature by steam, oil or infra-red radiation or being located in a preheated chamber. After completion of the heat treatment, the textile goods are separated from the carrier.

Preferably, synthetic fibre materials are treated, such as, for example, cellulose ester fibres, cellulose 2½ acetate and triacetate fibres, synthetic polyamide fibres, for example those from poly-ε-caprolactam (nylon 6), polyhexamethylenediamine adipate (nylon 6.6), poly-ω-aminoundecanoic acid (nylon 7), polyurethane or polyolefine fibres, for example polypropylene fibres, acid-modified polyamides, such as polycondensation products of 4,4'-diamino-2,2'-diphenyldisulphonic acid or 4,4'-diamino-2,2'-diphenylalkanedisulphonic acids with polyamide-forming starting materials, polycondensation products of monoaminocarboxylic acids or their amide-forming derivatives or of dibasic carboxylic acids and diamines with aromatic dicarboxysulphonic acids, for example polycondensation products of ε-caprolactam or hexamethylenediammonium adipate with potassium 3,5-dicarboxybenzenesulphonate, or acid-modified polyester fibres, such as polycondensation products of aromatic polycarboxylic acids, for example terephthalic acid or isophthalic acid, polyhydric alcohols, for example ethylene glycol and 1,2- or 1,3-dihydroxy-3-(3-sodium sulphopropoxy)-propane, 2,3-dimethylol-1-(3-sodium-sulphopropoxy)-butane, 2,2-bis-(3-sodium-sulphopropoxyphenyl)-propane or 3,5-dicarboxybenzenesulphonic acid or sulphonated terephthalic acid, sulphonated 4-methoxybenzenecarboxylic acid or sulphonated diphenyl-4,4'-dicarboxylic acid.

Preferably, however, fibre material of polyacrylonitrile or acrylonitrile copolymers and above all linear polyester fibres, especially of polyethylene glycol terephthalate or poly-(1,4-cyclohexanedimethylol) terephthalate, are used. If acrylonitrile copolymers are used, the proportion of acrylonitrile is suitably at least 50% and preferably at least 85 per cent by weight of the copolymer. The comonomers used are normally other vinyl compounds, for example vinylidene chloride, vinylidene cyanide, vinyl chloride, methacrylate, methylvinylpyridine, N-vinylpyrrolidone, vinyl acetate, vinyl alcohol, acrylamide or styrenesulphonic acids.

These fibre materials can also be used as mixed fabrics, the fibre materials being mixed with one another or with other fibres, examples being mixtures of polyacrylonitrile/polyester, polyamide/polyester, polyester/viscose and polyester/wool.

The fibre material can be in the most diverse states of processing, for example in the form of flocks, tow, yarn, texturised filaments, woven fabrics, knitted fabrics, fibre fleeces or textile floor coverings, such as needle-punched felt carpets, pile carpets or bundles of yarns.

The preparations which can be used according to the invention are applied to the temporary carrier by, for example, whole-area or partial spraying, coating or printing.

The temporary carriers can also be treated on both sides or, if appropriate, on the back, and unequal concentrations of the coatings can be selected for the two sides.

In the following examples percentages are percentages by weight.

EXAMPLE 1

750 g of tetrabromo-o-cresol (compare formula (4.5)) and 100 g of ethylcellulose are converted to a paste with 350 g of a 1:1 mixture of ethanol and methyl ethyl ketone.

The paste is applied to a paper strip by means of a doctor blade, so that the coating of tetrabromo-o-cresol is 30 g/m².

The carrier is placed with the coated side downwards onto a dyed knitted fabric of synthetic polyamide (180 g/m²) and both together are subjected to a heat treatment at 195°C between two heating plates for 25 seconds. The carrier is then separated from the knitted fabric. 9.3% of tetrabromo-o-cresol have been transferred to the polyamide knitted fabric. After 10 use-type washes at 40°C, 5.5% of active substance still remain on the knitted fabric.

The polyamide knitted fabric is flameproof according to DIN 53,906 (ignition time 4 seconds), in contrast to the untreated knitted fabric.

EXAMPLE 2

750 g of 2,4,6-tribromophenol (compare formula (4.4)) and 100 g of ethylcellulose are converted to a paste with 350 g of a 1:1 mixture of ethanol and methyl ethyl ketone.

The paste is applied to an aluminium foil by means of a doctor blade, so that the coating of 2,4,6-tribromophenyl is 30 g/m².

The carrier is placed with the coated side downwards onto a knitted fabric of synthetic polyamide (180 g/m², treated with 3% of potassium bichromate). The carrier and knitted fabric are together subjected to a heat treatment at 195°C between two heating plates for 25 seconds. The carrier and knitted fabric are then separated from one another. The treated knitted fabric is flameproof according to DIN 53,906 (ignition time 4 seconds), even after 10 use-type washes, in contrast to the untreated knitted fabric. 8.2% of 2,4,6-tribromophenol have been transferred to the polyamide knitted fabric.

EXAMPLE 3

750 g of the product of the formula (4.5) in 100 g of ethylcellulose and 350 g of a 1:1 mixture of ethanol and methyl ethyl ketone are converted to a paste and 24 or 48 g/m² are applied onto paper.

The coated side of the carrier is brought into contact with a polyester knitted fabric (240 g/m²) and the combination is subjected to a heat treatment at 195°C between two heating plates for 25 seconds. The carrier and knitted fabric are then separated from one another.

Thereafter, the knitted fabrics are tested for their flame resistance according to DOC FF 3-71 ("Children's Sleepwear Test"), the test being carried out after finishing and after 1, 5, 10, 20 and 40 use-type washes at 40°C in a liquor containing 4 g/l of a commercial detergent for delicate fabrics.

The result is summarised in the table which follows.

DOC FF 3-71 ("Children's Sleepwear Test") comprises the following flameproofing test:

5 pieces of fabric (8.9 cm × 25.4 cm) are clamped in a test frame and dried for 30 minutes at 105°C in a circulating air drying cabinet. The pieces of fabric are subsequently conditioned in a closed vessel over silica gel for 30 minutes and then subjected to the actual flame-resistance test in a burning box. The fabrics are in each case ignited for 3 seconds with a methane gas flame, the fabrics being in the vertical position.

The test is considered to have been withstood if the average charred zone is not longer than 17.5 cm and no one sample has a charred zone of more than 25.4 cm, and the individual smouldering times are not longer than 10 seconds.

EXAMPLE 4

22.5 g or 45 g of a compound of the formula (4.5) and 3 g or 6 g of ethylcellulose are worked into a paste with 10.5 or 21 g of a 1:1 ethanol/methyl ethyl ketone mixture and the paste is applied to a paper carrier of 1 m² surface area.

This carrier is then brought together with a polyacrylonitrile fibre carpet (pile weight 1,000 g/m², pile height 6 mm), with the coated side against the carpet, and the combination is warmed to 190°C between two heating plates for 40 seconds, without using pressure. The carrier and carpet are then separated from one another.

The carpet samples are then tested for their flame resistance in accordance with DIN 51,960, that is to say after finishing and after one and 3 shampooings. In contrast to an untreated sample, the treated samples are difficult to ignite. The results are summarised in the table which follows:

Shampooing

A commercial shampoo is mixed with water in the ratio of 8:1 and worked into a lather by means of a sponge. The lather is then applied to the carpet and well massaged into the pile by means of the sponge. After drying at room temperature, shampoo residues are thoroughly removed by means of a vacuum cleaner.

| | Coating, g/m² | Tested after | | | | | | | | | | | |
|---|---|---|---|---|---|---|---|---|---|---|---|---|---|
| | | Finishing | | 1 wash | | 5 washes | | 10 washes | | 20 washes | | 40 washes | |
| | | TL | BT | TL | BT | TL | BT | TL | BT | TL | BT | TL | BT |
| Untreated | | 12 | 22 | 4 | 9 | 10 | 25 | 4 | 19 | Burns | 28 | 6 | 15 |
| Treated with compound of the formula (4.5) | | 4 | 1 | 5.5 | 1 | 5 | 1 | 3 | 3 | 6 | 1 | 4 | 4 |
| (4.5) | | 8 | 5 | 5 | 5 | 5 | 1 | 4 | 1 | 4 | 1 | 5 | 2 |

TL : Tear length in cm
BT : Burning time in seconds

Instead of the compound of the formula (4.5), a compound of the formulae (4.1) to (4.4) can also be used, with similar success.

| | Coating, g/m² | Tested after | | | | | |
|---|---|---|---|---|---|---|---|
| | | Finishing | | 1 shampooing | | 3 shampooings | |
| | | BL | BT | BL | BT | BL | BT |
| Untreated | | Burns away | 7' | Burns away | 6'45" | Burns away | 12'15" |
| Treated with compound of the formula (4.5) | 22.5 | 7.5 | 3:25 | 10 | 9:00 | 8 | 6:10 |

-continued

| | Coating, g/m² | Tested after Finishing BL | Finishing BT | 1 shampooing BL | 1 shampooing BT | 3 shampooings BL | 3 shampooings BT |
|---|---|---|---|---|---|---|---|
| (4.5) | 45 | 6 | 6:20 | 6 | 4:50 | 6 | 5:10 |

BL : Burning length in cm
BT : Burning time in minutes and seconds

EXAMPLE 5

50 g of the compound of the formula (4.1) are dissolved in 50 g of methyl ethyl ketone.

This solution is uniformly distributed over a felt of polytetrafluoroethylene fibres of 1 m² surface area, by padding using a smooth metal roller. After evaporation of the methyl ethyl ketone, the felt of polytetrafluoroethylene fibres is placed with the coated side against the pile side of a polyacrylonitrile fibre carpet (pile weight 600 g/m²) and the combination is heated to 200°C between two heating plates for 45 seconds. The felt of polytetrafluoroethylene fibres and the polyacrylonitrile fibre carpet are then separated from one another.

The carpet treated in this way and an untreated carpet are compared and tested for their flame resistance according to DIN 51,960. The treated carpet is difficult to ignite, whilst the untreated carpet burns away completely.

EXAMPLE 6

The compound of the formula (4.2), which is in the form of a powder, is evenly trickled onto a stainless steel fibre fleece so as to produce a coating of 350 g/m². The compound of the formula (4.2) anchors to the fibrous surface of the fleece. The coated side of the fleece is now placed on a polyester woven fabric (250 g/m²) and the combination is subjected to a heat treatment at 195°C between two heating plates for 1 minute. The polyester fabric treated in this way and an untreated fabric are tested for their flame resistance according to DIN 53,906 (ignition time 4 seconds).

Whilst untreated fabric continues to burn for 19 seconds, treated fabric has already ceased to burn after 5 seconds.

EXAMPLE 7

The compound of the formula (4.3) is applied to a pre-chromed polyamide knitted fabric (nylon 6,6) in the manner indicated in Example 6.

The following results are obtained in the flame-resistance test according to DOC FF 3-71:

| | Burning time in seconds | Tear length in cm |
|---|---|---|
| Treated polyamide knitted fabric | 3 | 6 |
| Untreated polyamide knitted fabric | 30 | Burns away completely |

We claim:

1. Process for flameproofing organic fiber material by the dry thermal transfer process which comprises applying to an inert carrier a preparation comprising a halogen compound of the formula

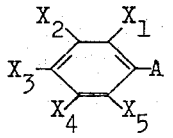

wherein A is halogen, hydroxyl, alkoxycarbonyl with 2 to 5 carbon atoms, halogenoalkoxy with 1 to 4 carbon atoms or halogenophenyl and $X_1$, $X_2$, $X_3$, $X_4$ and $X_5$ are each halogen, alkyl with 1 to 4 carbon atoms, hydroxyl or hydrogen, but at most one of the radicals $X_1$, $X_2$, $X_3$, $X_4$ and $X_5$ is alkyl or hydroxyl and at least one of the radicals is halogen, and $X_1$ and A can together be a radical of the formula —CO—O—CO—, bringing the carrier into contact with the surface of the fiber material which is to be flameproofed, thereafter subjecting the carrier and the material to be finished to a heat treatment at 150° to 220°C, until the halogen compound has been transferred to the fiber material, and then separating the finished material from the carrier.

2. Process according to claim 1 which comprises applying a preparation comprising a halogen compound of the formula

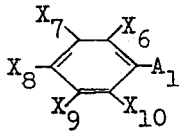

wherein $A_1$ is bromine, hydroxyl, alkoxycarbonyl with 2 or 3 carbon atoms, bromoalkoxy with 2 or 3 carbon atoms and 1 to 3 bromine or bromophenyl with 1 to 5 bromine and $X_6$, $X_7$, $X_8$, $X_9$ and $X_{10}$ are each bromine, hydroxyl or hydrogen, but at most one of the radicals $X_6$, $X_7$, $X_8$, $X_9$ and $X_{10}$ is hydroxyl and at least one of these radicals is bromine, and $X_6$ and $A_1$ can together be a radical of the formula —CO—O—CO—.

3. Process according to claim 1 which comprises applying a preparation comprising a halogen compound of the formula

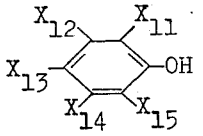

wherein $X_{11}$, $X_{12}$, $X_{13}$, $X_{14}$ and $X_{15}$ are each hydrogen, methyl or bromine, with at least three of the radicals $X_{11}$, $X_{12}$, $X_{13}$, $X_{14}$ and $X_{15}$ being bromine.

4. Process according to claim 3 which comprises applying a preparation comprising tetrabromo-o-cresol.

5. Process according to claim 3 which comprises applying a preparation comprising 2,4,6-tribromophenol.

6. Process according to claim 2 which comprises applying a preparation comprising 1-(2',3'-dibromo-propoxy)-2,4,6-tribromo-benzene.

7. Process according to claim 2 which comprises applying a preparation comprising 2,2',3,3',5,5'-hexa-bromodiphenyl.

8. Process according to claim 2 which comprises applying a preparation comprising tetrabromo-phthalic acid anhydride.

9. Process according to claim 1 which comprises applying a preparation containing, in addition to the halogen compound, a binder which is stable below 250°C and an organic solvent.

10. Process according to claim 1 which comprises applying a preparation comprising from 20 to 100 per cent by weight of the halogen compound, 0 to 30 per cent by weight of a binder which is stable below 250°C and 0 to 70 per cent by weight of an organic solvent.

11. Process according to claim 1 wherein the organic fiber material comprises polyamide fibers, polyacrylonitrile fibers or linear polyesters fibers.

12. Process according to claim 1 wherein the carrier consists of a paper strip, an aluminium foil, a steel fiber fleece or a felt of polytetrafluoroethylene fibers.

* * * * *